US008801535B2

(12) United States Patent
Furey

(10) Patent No.: US 8,801,535 B2
(45) Date of Patent: Aug. 12, 2014

(54) GOLF PUTTER AND METHODS THEREOF

(76) Inventor: James Furey, Morganville, NJ (US)

( * ) Notice: Subject to any disclaimer, the term of this patent is extended or adjusted under 35 U.S.C. 154(b) by 203 days.

(21) Appl. No.: 12/790,318

(22) Filed: May 28, 2010

(65) Prior Publication Data

US 2011/0294598 A1 Dec. 1, 2011

(51) Int. Cl.
*A63B 53/14* (2006.01)

(52) U.S. Cl.
USPC ..... 473/300; 473/294

(58) Field of Classification Search
USPC ..... 473/203, 294, 298, 293, 296, 300–303
See application file for complete search history.

(56) References Cited

U.S. PATENT DOCUMENTS

| | | | | |
|---|---|---|---|---|
| 2,843,384 | A * | 7/1958 | Schmidt | 473/204 |
| 3,679,207 | A * | 7/1972 | Florian | 473/292 |
| 5,125,130 | A * | 6/1992 | Stanish | 16/430 |
| 5,554,078 | A * | 9/1996 | Hannon et al. | 473/292 |
| 6,213,890 | B1 * | 4/2001 | Prince | 473/292 |
| 6,663,499 | B2 * | 12/2003 | Riseley | 473/294 |
| 6,966,846 | B2 * | 11/2005 | Bloom, Jr. | 473/292 |
| 7,510,483 | B2 * | 3/2009 | Tremulis et al. | 473/300 |
| 8,066,585 | B2 * | 11/2011 | Tremulis et al. | 473/300 |
| 2002/0025858 | A1 * | 2/2002 | Sosin | 473/340 |
| 2003/0069081 | A1 * | 4/2003 | Jung | 473/325 |
| 2004/0043828 | A1 * | 3/2004 | Goldfader | 473/303 |
| 2004/0198528 | A1 * | 10/2004 | Balcer | 473/293 |
| 2005/0130758 | A1 * | 6/2005 | Riseley | 473/313 |
| 2006/0009303 | A1 * | 1/2006 | Prince et al. | 473/297 |
| 2011/0039642 | A1 * | 2/2011 | Phelan, Jr. | 473/568 |

* cited by examiner

*Primary Examiner* — Stephen L. Blau
(74) *Attorney, Agent, or Firm* — Jon Fallon, Esq.; Michael P. Kochka, Esq.

(57) ABSTRACT

Embodiments of the present invention generally relate to a golf putter and methods of using the same. More specifically, embodiments relate to an improved golf putter, designed to allow a golfer to utilize the putter in a novel manner, yielding enhanced results. In one embodiment, a golf putter comprises a club head having a face thereon, the face designed to impact a golf ball; a shaft, connected on a first end to the club head; a golf grip, positioned on a second end of the shaft, the golf grip having a first gripping section positioned beneath a second gripping section; wherein the first gripping section of the golf grip comprises an first ergonomic cross-section, for being gripped by a control hand of a golfer; and wherein the second gripping section of the golf grip comprises a second ergonomic cross-section, for being gripped by a stabilizing hand of the golfer.

20 Claims, 5 Drawing Sheets

GOLF PUTTER AND METHODS THEREOF

BACKGROUND OF THE INVENTION

1. Field of the Invention

Embodiments of the present invention generally relate to a golf putter and methods of using the same. More specifically, embodiments of the present invention relate to an improved golf putter, designed to allow a golfer to utilize the putter in a novel manner, yielding enhanced results.

2. Description of the Related Art

Golf theory teaches that a putting stroke should be executed in generally pendulum-like fashion. In the conventional method for putting, the hands of the golfer are typically located one beneath the other and grasp the shaft in a reverse overlap grip, thereby positioning one shoulder beneath the other. During the stroke, in order to approximate pendulum-like movement, a body adjustment is made, to compensate for the fact that the shoulders are not naturally level upon address of the ball. Generally, this requires undesired movement of the forearms and/or wrists. While this conventional method has clearly proven satisfactory over time, it is difficult to execute with consistency, since the necessary body adjustment is a complex physical movement.

In addition, when striking the ball, it is often difficult for a golfer to maintain a rigid form, even when concentrating on maintaining form over all other parameters. Too often, a golfer may break his or her wrists at moment before impact, causing the face of the club head to strike the golf ball in an undesirable manner, usually causing a poor putt.

Thus, there is a need for improved golf putter, designed to allow a golfer to utilize the putter in a novel manner, yielding enhanced results.

SUMMARY OF THE INVENTION

Embodiments of the present invention generally relate to a golf putter and methods of using the same. More specifically, embodiments of the present invention relate to an improved golf putter, designed to allow a golfer to utilize the putter in a novel manner, yielding enhanced results.

In one embodiment of the present invention, a golf putter comprises a club head having a face thereon, the face designed to impact a golf ball; a shaft, connected on a first end to the club head; a golf grip, positioned on a second end of the shaft, the golf grip having a first gripping section positioned beneath a second gripping section; wherein the first gripping section of the golf grip comprises an first ergonomic cross-section, for being gripped by a control hand of a golfer; and wherein the second gripping section of the golf grip comprises a second ergonomic cross-section, for being gripped by a stabilizing hand of the golfer.

In another embodiment of the present invention, a golf grip for adaption to a standard golf putter shaft, comprises: a first gripping section comprising an first ergonomic cross-section, for being gripped by a control hand of a golfer in a traditional manner, whereby the index finger and thumb of the control hand grasp the first gripping section at a point beneath the remaining fingers of the control hand; a second gripping section of the golf grip comprising a second ergonomic cross-section, for being gripped by a stabilizing hand of the golfer in a manner whereby the index finger and thumb of the stabilizing hand grasp the second gripping section at a point above the remaining fingers of the stabilizing hand; and an adaption means for adapting to a standard golf putter shaft.

In yet another embodiment of the present invention, A method of stroking a golf ball on a putting green, comprises:

providing a golf putter comprising a club head having a face thereon, the face designed to impact a golf ball; a shaft, connected on a first end to the club head; a golf grip, positioned on a second end of the shaft, the golf grip having a first gripping section positioned beneath a second gripping section; wherein the first gripping section of the golf grip comprises an first ergonomic cross-section, for being gripped by a control hand; and wherein the second gripping section of the golf grip comprises a second ergonomic cross-section, for being gripped by a stabilizing hand; gripping the first gripping section using the control hand, whereby the index finger and thumb of the control hand grasp the first gripping section at a point beneath the remaining fingers of the control hand; gripping the second gripping section of the golf grip using the stabilizing hand, whereby the index finger and thumb of the stabilizing hand grasp the second gripping section at a point above the remaining fingers of the stabilizing hand; aligning the face of the club head against the golf ball, positioned perpendicular to a line of desired direction of the golf ball; and creating a pendulum motion using a control shoulder and a stabilizing shoulder, initially in a direction away from the golf ball, followed by a direction towards the golf ball, making contact therewith.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
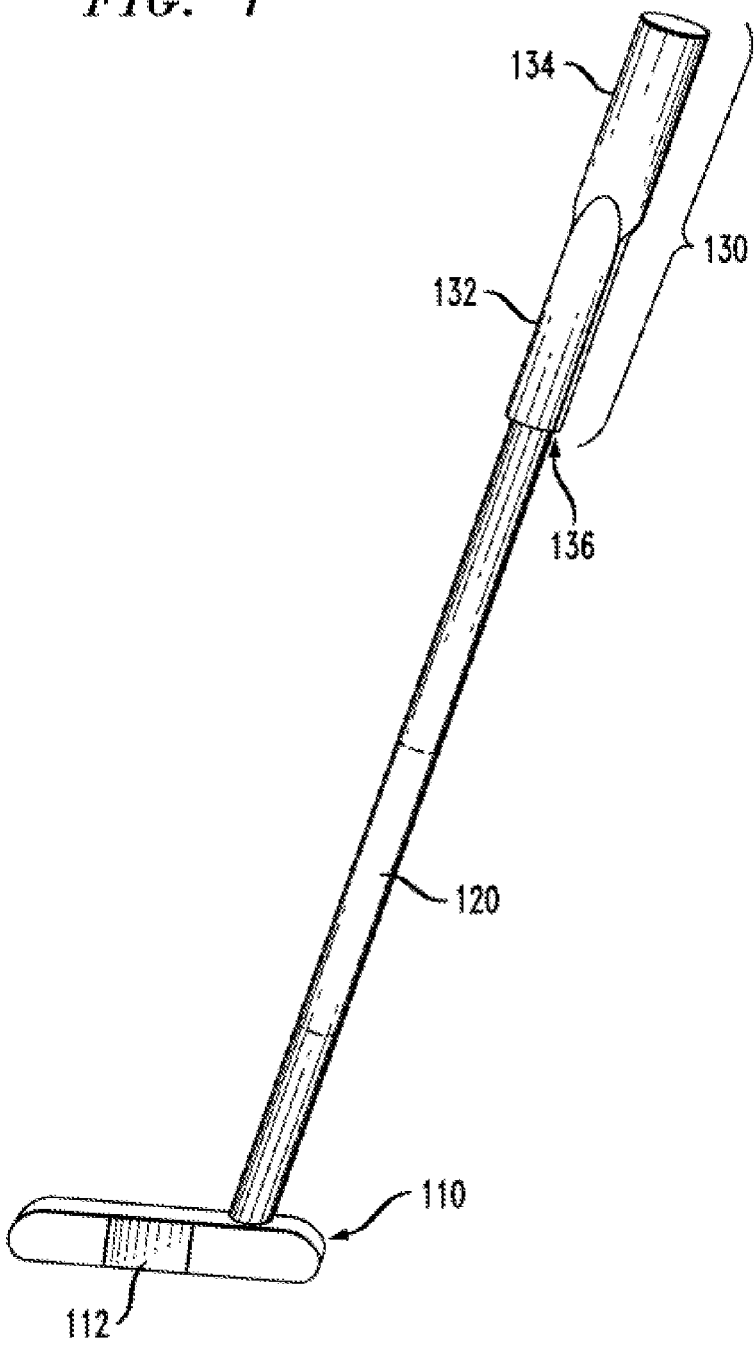
FIG. 1 depicts a perspective view of a golf putter in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention generally relate to a golf putter and methods of using the same. More specifically, embodiments of the present invention relate to an improved golf putter, designed to allow a golfer to utilize the putter in a novel manner, yielding enhanced results.

FIG. 1 depicts a perspective view of a golf putter in accordance with one embodiment of the present invention. A golf putter 100 generally comprises a club head 110 having a face 112 thereon, a substantially rigid shaft 120, and a golf grip 130. In accordance with embodiments of the present invention, the club head 110 may comprise any type of club head currently utilized and known in the industry, suitable for embodiments of the present invention. For example, in one embodiment, the club head 110 may comprise a blade putter head, a peripheral weighted putter head, a mallet putter head, or the like.

Similarly, the face 112 of the club head 110 may comprise any suitable face for embodiments of the present invention. In one embodiment, the face 112 may comprise a traditional metal face, an insert face, a groove face or the like. In many embodiments, the face 112 is qualified as any surface designed to impact a golf ball when the golf putter 100 is in use.

The shaft 120 generally comprises a substantially rigid material, and in many embodiments is made of a metal, a metal alloy, a polymer, combinations thereof or the like. The shaft 120 may be of any length suitable for embodiments of the present invention, which is often dictated by the height of a golfer and/or the length of a golfer's arms. In many embodiments, the shaft may comprise a length of between about 32 inches and about 52 inches. In other embodiments, the shaft may comprise a length of between about 35 inches to about 42 inches.

The golf grip 130 generally comprises a first gripping section 132, a second gripping section 134 and an adaption means 136 for adapting the golf grip 130 to the shaft 120. The adapting means 136 may comprise any means suitable for embodiments of the present invention. In one embodiment, the adapting means 136 comprising the opening to a hollow cavity within the golf grip 130 for allowing the shaft 120 to enter into the cavity and create a friction fit with the golf grip 130. In another embodiment, the adaption means 136 comprises a snap lock, a screw lock, an adhesive, or the like for adapting the golf grip 130 to the shaft 120.

The first gripping section 132 section of the golf grip 130 comprises a first ergonomic cross-section, for being gripped by a control hand of a golfer. The second gripping section 134 of the golf grip 130 comprises a second ergonomic cross-section, for being gripped by a stabilizing hand of a golfer. Generally, the cross-sections of the first gripping section 132 and the second gripping section 134, respectively, are angled copies of one another (e.g., ranging from about 30 degrees to 90 degrees). That is, in many embodiments, the cross-section of the first gripping section 132 is the same as that of the second gripping section 134, rotated at a predetermined angle. A more detailed discussion of the cross-sections of the first and second gripping sections 132 and 134 is provided herein with respect to FIGS. 2, 3 and 3A.

The first gripping section 132 and the second gripping section 134 may be positioned adjacent to each other, or may be a set distance apart. In one embodiment, the bottom of the first gripping section 132 is between about 12 inches to about 24 inches from the top of the second gripping section 134. In many embodiments, the length of the golf grip 130 is dependent upon the length of a golfer's forearm and hand, such that the length of the golf grip 130 may be substantially the length of the golfer's outstretched fingers up to the elbow. In other embodiments, the length between the first gripping section 132 and the second gripping section 134 is about 8 inches to about 14 inches.

The golf grip 130 may generally comprise any material suitable for embodiments of the present invention. In one embodiment, the golf grip 130 comprises a corded material having any one of natural or synthetic materials therein. Where a corded material is provided, generally the cord material will be wrapped around the shaft 120 and will be provided with an adhesive on the underside thereof. Such hard, corded materials may include leather, rubber, or the like.

In another embodiment, the golf grip 130 may comprise a slip-on material, generally, a natural or synthetic rubber, or blends thereof. A slip-on material is generally assembled as a golf grip 130 in its entirety before being adapted to a shaft 120. Such exemplary slip-on golf grips are often manufactured using a rubber extrusion process, or similar process to yield a self-stabilized grip, independent of any other golf putter component.

Figure 2:
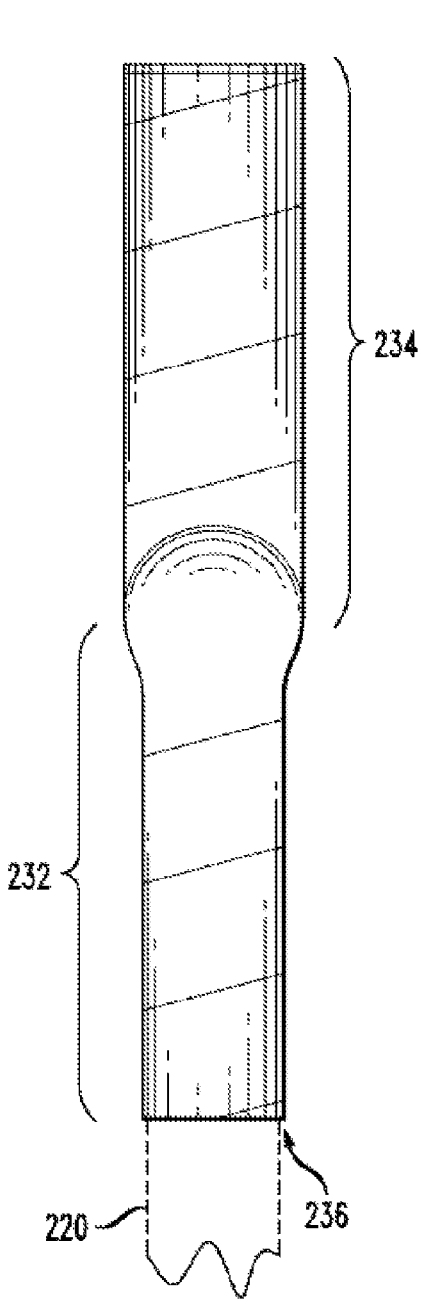
FIG. 2 depicts a side view of the grip of the golf putter in accordance with one embodiment of the present invention.
Figure 3:
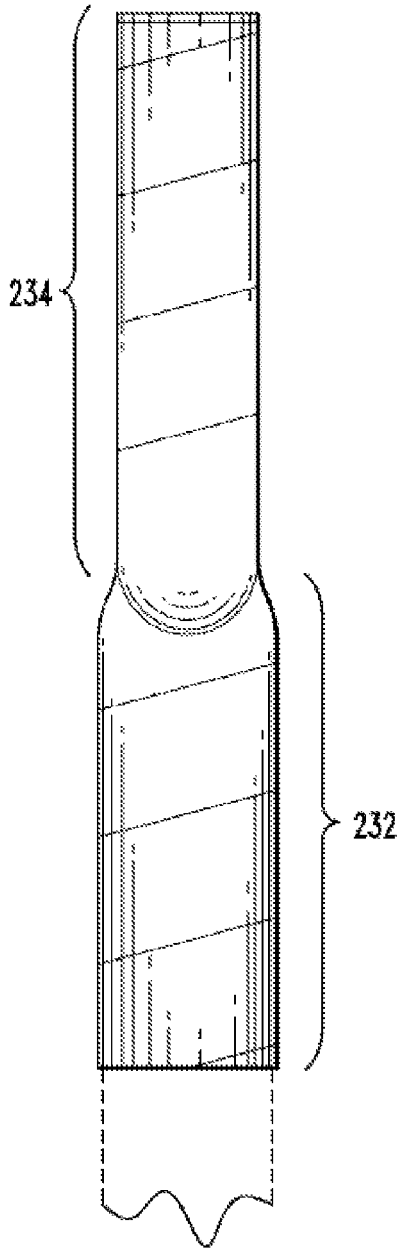
FIG. 3 depicts a front view of the grip of the golf putter shown in FIG. 2.

FIG. 2 depicts a side view of the grip of the golf putter in accordance with one exemplary embodiment of the present invention. As introduced above, the golf grip 200 generally comprises a first gripping section 232, a second gripping section 234 and an adaption means 236 for adapting the golf grip 200 to the shaft 220. As portrayed in the exemplary embodiment shown in the Figure, the first gripping section 232 has a different width (or cross-section) than the second gripping section 234, and is clearly more narrow. However, when compared to FIG. 3, depicting a front view of the grip of the golf putter shown in FIG. 2, the second gripping section 234 is more narrow than the first gripping section 232. In such an embodiment, the cross-section of each the first and second gripping sections 232 and 234 are substantially oval, positioned at a predetermined angle to one another.

Figure 3A:
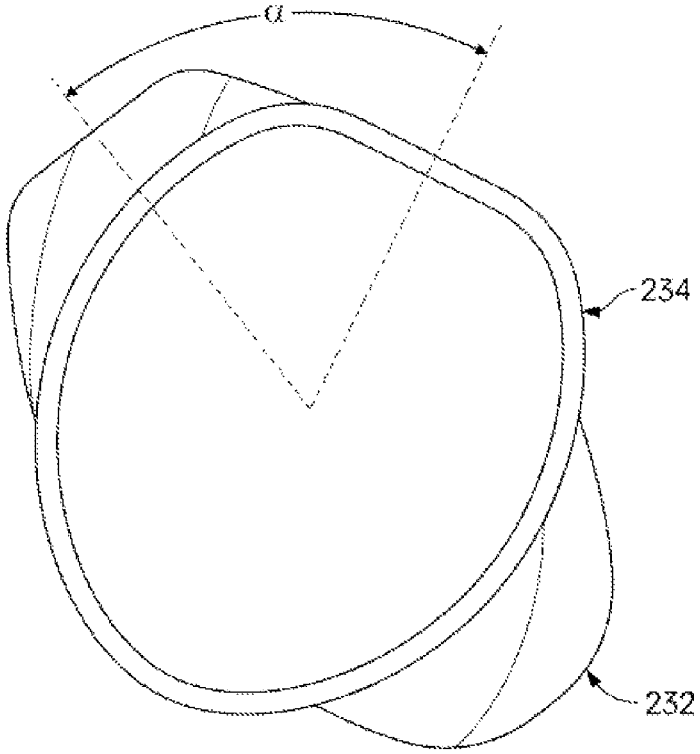
FIG. 3A depicts a top view of the grip of the golf putter shown in FIG. 3.

In accordance with many embodiments of the present invention, the cross-section of each of the first gripping section 232 and second gripping section 234 may comprise any shape or configuration suitable for embodiments of the present invention. Accordingly, such shape need only be ergonomically designed for proper golfer form, as discussed herein. For example, as shown in FIG. 3A, depicting a top view of the exemplary golf grip shown in FIG. 3, the first gripping section 232 and the second gripping section 234 comprise substantially oval cross sections, having at least one slightly flattened edge, where such edges are positioned at an angle $\alpha$ away from each other.

While embodiments of the present invention may comprise first and second gripping sections 232 and 234 having substantially similar cross-sections at predetermined angles to one another, embodiments of the present invention contemplate any plausible cross-section shape, whereby the first and second gripping sections 232 and 234 are independent of one another.

Figure 4:
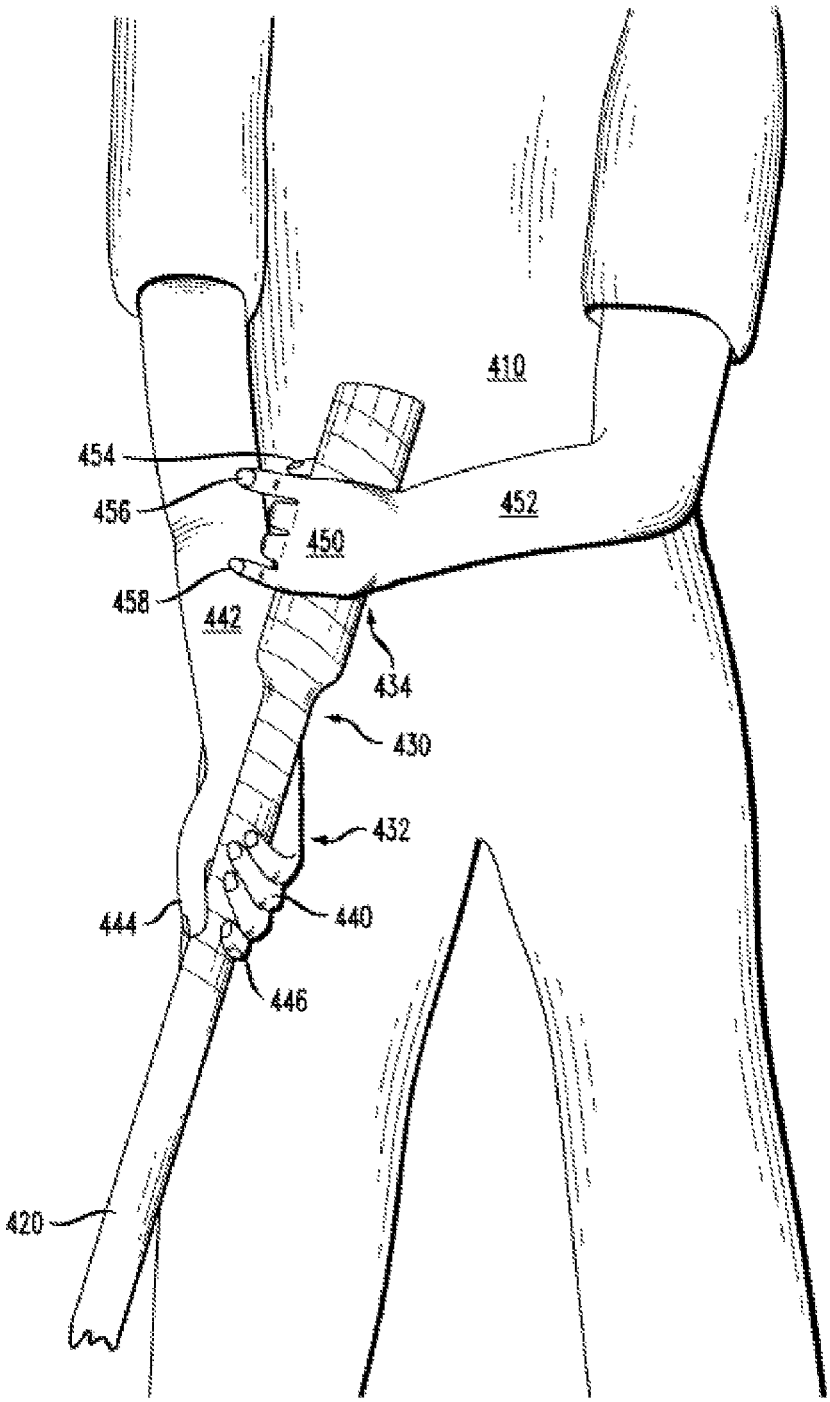
FIG. 4 depicts a schematic of a golfer's body positioning in relation to a golf putter in accordance with one embodiment of the present invention.

FIG. 4 depicts a schematic of a golfer's body positioning in relation to a golf putter in accordance with one exemplary embodiment of the present invention. In use, a golfer 410 may utilize a golf putter, designed in accordance with embodiments of the present invention, to enhance putting performance on a putting green. As shown in the exemplary embodiment depicted in the Figure, a golfer 410 generally comprises a control hand 440 at the end of a control arm 442, which is connected with a control shoulder (not shown). Similarly, a golfer 410 comprises a stabilizing hand 450 at the end of a stabilizing arm 452, which is connected with a stabilizing shoulder (not shown).

Figure 5:
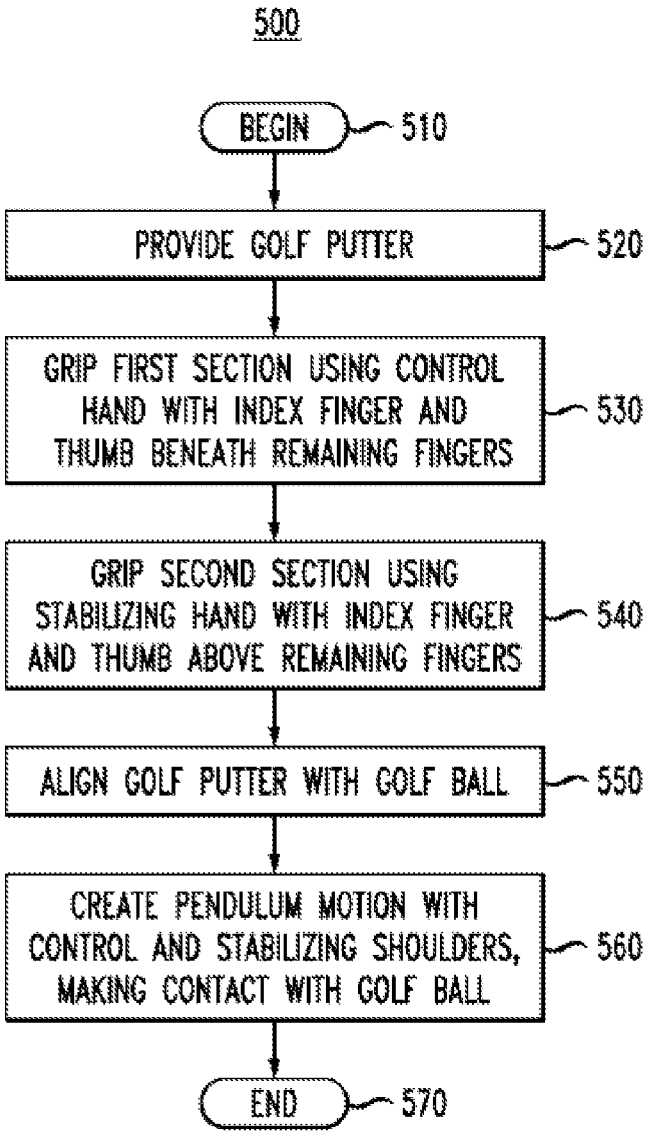
FIG. 5 depicts a flowchart showing a method of utilizing a golf putter in accordance with one embodiment of the present invention.

FIG. 5 depicts a flowchart showing a method of utilizing a golf putter in accordance with one embodiment of the present invention. FIG. 5 may be described in connection with the embodiment shown in FIG. 4, and will utilize such reference numbers where appropriate. The method of utilizing a golf putter beings at step 510. At step 520, a golf putter is provided, the golf putter comprising a shaft 420, connected on a first end to a club head having a face, and a golf grip 430 having a first gripping section 432 and a second gripping section 434.

At step 530, a golfer 410 may grip the first gripping section 432 using a control hand 440, whereby an index finger 446 and thumb 444 of the control hand 440 are situated at a point beneath the remaining fingers of the control hand 440.

At step 540, a golfer 410 may grip the second gripping section 434 using a stabilizing hand 450, whereby an index finger 456 and thumb 454 of the stabilizing hand 450 are situated at a point above the remaining fingers of the stabilizing hand 450. In one optional embodiment, when gripping the second gripping section 434, the golfer 410 may fully extend and brace at least one finger of the stabilizing hand 450 against a control arm 442. In one of such embodiments, the golfer 410 may utilize the index finger 456 of the stabilizing hand 450 and/or a pinky finger 458 of the stabilizing hand 450 to brace against the control arm 442 for enhanced precision and rigidity of the golfer's frame.

At step 550, the golfer 410 will utilize a line of sight to align the golf putter with a golf ball on a putting green. In many embodiments, the alignment may be between the golf ball and a hole on a putting green. In alternative embodiments, the alignment may be between the golf ball and a desired location, either for advantageous positioning on the golf green or for some other purpose.

At step 560, the golfer 410 will create a pendulum motion with the control shoulder and stabilizing shoulder, while maintaining the golfer's frame. In view of such frame, the control and stabilizing shoulder should naturally rotate simultaneously, as the control arm 442 and stabilizing arms 452, respectively connected thereto, force the shoulders to cooperate with one another. The pendulum motion will generally begin away from the golf ball, when the golfer 410 is standing with traditional putting footing (i.e., adjacent the golf ball, initially with the putter face aligned proximate the desired striking location of the golf ball). When a desired pendulum force is reached, the golfer 410 will generally change direction of the pendulum motion back towards the golf ball, and will make contact therewith using the face of the club head of the golf putter. The exemplary method 500 ends at step 570, and the method 500 may be repeated as many times as necessary until the golfer 410 satisfactorily completes the golf hole.

While the foregoing is directed to embodiments of the present invention, other and further embodiments of the invention may be devised without departing from the basic scope thereof.

What is claimed is:

1. A golf putter comprising:

a club head having a face thereon, the face designed to impact a golf ball;

a shaft, connected on a first end to the club head;

a golf grip, positioned on a second end of the shaft, the golf grip having a first gripping section positioned beneath a second gripping section;

wherein the first gripping section of the golf grip comprises an first ergonomic cross-section, for being gripped by a control hand of a golfer, the first ergonomic cross-section being suited for an index finger and a thumb of the control hand positioned at a point beneath remaining fingers of the control hand;

wherein the second gripping section of the golf grip comprises a second ergonomic cross-section, for being gripped by a stabilizing hand of the golfer, the second ergonomic cross-section being suited for an index finger and a thumb of the stabilizing hand positioned at a point above remaining fingers of the stabilizing hand, the second ergonomic cross section rotated at a predetermined angle in relation to the first ergonomic cross section; and wherein the first gripping section and the second gripping section comprise oval cross sections, each having at least one slightly flattened edge, and wherein the at least one slightly flattened edge of the first gripping section and the at least one slightly flattened edge of the second gripping section are rotated at the predetermined angle away from each other.

2. The golf putter of claim 1, wherein the shaft comprises between about 32 inches to about 52 inches in length.

3. The golf putter of claim 2, wherein the shaft comprises between about 35 inches to about 42 inches in length.

4. The golf putter of claim 1, wherein the golf grip comprises about 12 inches to about 24 inches in length.

5. The golf putter of claim 4, wherein about 8 inches to about 14 inches exists between the first gripping section and the second gripping section.

6. The golf putter of claim 1, wherein the golf putter comprises any one of a face balanced putter, a toe balanced putter, a blade putter, a peripheral weighted putter, a mallet putter, a metal faced putter, an insert faced putter, a groove faced putter, a heel-shafted putter, a centre-shafted putter, or a hosel offset putter.

7. The golf putter of claim 1, wherein the golf grip permits a golfer to grasp the first gripping section with the control hand in a traditional manner whereby the index finger and thumb of the control hand grasp the first gripping section at a point beneath the remaining fingers of the control hand.

8. The golf putter of claim 7, wherein the golf grip permits the golfer to grasp the second gripping section with the stabilizing hand in a manner whereby the index finger and thumb of the stabilizing hand grasp the second gripping section at a point above the remaining fingers of the stabilizing hand.

9. The golf putter of claim 8, wherein the second gripping section is designed to support at least one finger of the stabilizing hand to be fully extended and braced against a control arm of the golfer.

10. The golf putter of claim 9, wherein the at least one finger comprises both the pinky and index fingers.

11. A golf grip for adaption to a standard golf putter shaft, comprising:

a first gripping section comprising an first ergonomic cross-section, for being gripped by a control hand of a golfer in a traditional manner, whereby the index finger and thumb of the control hand grasp the first gripping section at a point beneath the remaining fingers of the control hand;

a second gripping section of the golf grip comprising a second ergonomic cross-section, for being gripped by a stabilizing hand of the golfer in a manner whereby the index finger and thumb of the stabilizing hand grasp the second gripping section at a point above the remaining fingers of the stabilizing hand the second ergonomic cross section rotated at a predetermined angle in relation to the first ergonomic cross section;

wherein the first gripping section and the second gripping section comprise oval cross sections, each having at least one slightly flattened edge, and wherein the at least one slightly flattened edge of the first gripping section and the at least one slightly flattened edge of the second gripping section are rotated at the predetermined angle away from each other; and an adaption means for adapting to a standard golf putter shaft.

12. The golf grip of claim 11, wherein the second gripping section is designed to support at least one finger of the stabilizing hand to be fully extended and braced against a control arm of the golfer.

13. The golf grip of claim 12, wherein the at least one finger comprises both the pinky and index fingers.

14. The golf grip of claim 11, wherein about 8 inches to about 14 inches exists between the first gripping section and the second gripping section.

15. A method of stroking a golf ball on a putting green, comprising:

providing a golf putter comprising:

a club head having a face thereon, the face designed to impact a golf ball;

a shaft, connected on a first end to the club head;

a golf grip, positioned on a second end of the shaft, the golf grip having a first gripping section positioned beneath a second gripping section;

wherein the first gripping section of the golf grip comprises an first ergonomic cross-section, for being gripped by a control hand;

wherein the second gripping section of the golf grip comprises a second ergonomic cross-section, for being gripped by a stabilizing hand, the second ergonomic cross section rotated at a predetermined angle in relation to the first ergonomic cross section;

wherein the first gripping section and the second gripping section comprise oval cross sections, each having at least one slightly flattened edge, and wherein the at least one slightly flattened edge of the first gripping section and the at least one slightly flattened edge of the second gripping section are rotated at the predetermined angle away from each other;

gripping the first gripping section using the control hand, whereby the index finger and thumb of the control hand grasp the first gripping section at a point beneath the remaining fingers of the control hand;

gripping the second gripping section of the golf grip using the stabilizing hand, whereby the index finger and thumb of the stabilizing hand grasp the second gripping section at a point above the remaining fingers of the stabilizing hand;

aligning the face of the club head against the golf ball, positioned perpendicular to a line of desired direction of the golf ball; and creating a pendulum motion using a control shoulder and a stabilizing shoulder, initially in a direction away from the golf ball, followed by a direction towards the golf ball, making contact therewith.

16. The method of claim 15, wherein gripping the second gripping section comprises fully extending and bracing at least one finger of the stabilizing hand against a control arm.

17. The method of claim 16, wherein the at least one finger comprises both the pinky and index fingers.

18. The method of claim 15, wherein the shaft comprises between about 35 inches to about 42 inches in length.

19. The method of claim 15, wherein the golf grip comprises about 12 to about 24 inches in length.

20. The method of claim 19, wherein about 8 inches to about 14 inches exists between the first gripping section and the second gripping section.

* * * * *